US005786525A

United States Patent [19]

Freund et al.

[11] Patent Number: 5,786,525

[45] Date of Patent: Jul. 28, 1998

[54] METHOD AND APPARATUS FOR BALANCING AN AIR DISTRIBUTION SYSTEM

[75] Inventors: Mark G. Freund, Oggiono, Italy; Ronald Schram, Wauwatosa, Wis.

[73] Assignee: Johnson Service Company, Milwaukee, Wis.

[21] Appl. No.: 629,607

[22] Filed: Apr. 9, 1996

[51] Int. Cl.[6] ..... F24F 7/00

[52] U.S. Cl. ..... 73/3

[58] Field of Search ..... 73/3, 118.2, 714, 73/722, 861.04, 861.66, 861.78; 236/49.1, 49.3, 49.4, 49.5

[56] References Cited

U.S. PATENT DOCUMENTS

| | | | |
|---|---|---|---|
| 4,344,330 | 8/1982 | Renken et al. | 73/861.66 |
| 4,449,664 | 5/1984 | Mithuhira et al. | 73/861.78 |
| 4,606,229 | 8/1986 | Spence | 73/722 |
| 4,838,483 | 6/1989 | Nurczyk et al. | 73/3 |
| 5,167,366 | 12/1992 | Desmarais et al. | 73/714 |
| 5,267,897 | 12/1993 | Drees | 73/861.04 |
| 5,479,812 | 1/1996 | Juntunen et al. | 73/3 |

*Primary Examiner*—George M. Dombroske
*Attorney, Agent, or Firm*—Quarles & Brady

[57] ABSTRACT

A flow measurement device and a VAV device are adapted to be directly coupled. The flow measurement device is adapted to automatically make and record flow measurements and to communicate the measurements to a VAV controller. The VAV controller is adapted to receive the flow measurements and self calibrate in response thereto. The VAV device is further adapted to report results of the calibration process to a system central and/or supervisory controller.

12 Claims, 1 Drawing Sheet

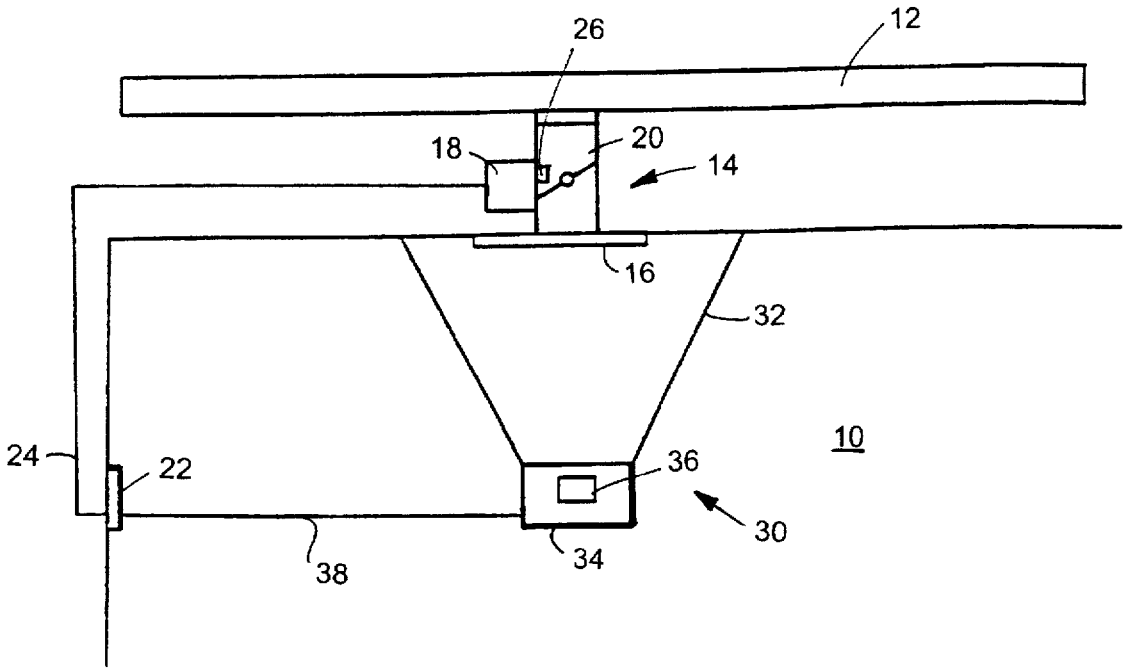
26
12
18
20
14
16
32
10
24
22
36
30
38
34

METHOD AND APPARATUS FOR BALANCING AN AIR DISTRIBUTION SYSTEM

FIELD OF THE INVENTION

The present invention relates generally to air distribution systems, and more particularly, to a method and apparatus for balancing an air distribution system.

BACKGROUND OF THE INVENTION

Modern building heating, cooling and air conditioning (HVAC) systems include as an integral sub-system an air distribution system. The task of the air distribution system is to provide a sufficient supply of conditioned air (typically a heated/humidified or cooled/dehumidified mixture of return and fresh air) to a building zone for achieving desired environmental conditions within the zone. Often referred to as indoor air quality (IAQ), the quality, i.e., the temperature, humidity and freshness of air, within a building environment is very closely related to the ability of the air distribution system to provide conditioned air in the proper volumes to the zones of the building.

In a multi-zone building system, conditioned air is typically provided via an air trunk or plenum to a number of variable-air-volume (VAV) distribution devices which control the volume of air delivered to a particular zone in response to a command signal. The command signal may be directly received from a thermostat within the zone or may be from a central controller. The VAV device includes a controller device which receives the command signal and according to the control algorithm contained within the controller affects the position of mechanical devices (such as dampers) for controlling the flow of conditioned air from the air trunk and into the zone. Typical VAV devices also include a pressure sensor or other flow measurement device which provide the signals from which the VAV controller uses to determine the flow provided by the VAV device into the zone. To provide good air flow control, the pressure sensor must be calibrated to the air flow pickup, ductwork and static pressure of the air distribution system.

Calibration, also referred to as balancing, is a manual task in which a trained test and balance technician measures the air flow into each zone of the building with a flow measuring device. In order to calibrate the many VAV devices of the air distribution system, the technician places the flow measuring device in the zone being calibrated and sets the VAV controller to provide a minimum air flow. The technician takes a measurement and calculates a gain factor for the VAV controller and adjusts the controller accordingly. Next the technician sets the VAV controller to provide a maximum air flow and repeats the steps of measuring, calculating and adjusting. The technician is required to repeat this process for each zone of the building. In addition to lending itself to errors in reading measurements and making calculations, the process may take 15 minutes or longer for each zone being calibrated. Thus, there is a need for an apparatus and method for quickly and accurately balancing the VAV devices of an air distribution system.

SUMMARY OF THE INVENTION

The present invention provides a flow measurement device and a VAV device which are adapted to be directly coupled. The flow measurement device is adapted to automatically make and record flow measurements and to communicate the measurements to the VAV controller. The VAV controller is adapted to receive the flow measurements and self calibrate in response thereto. The VAV device is further adapted to report results of the calibration process to a system supervisory controller.

The flow measurement device may be coupled via a wired link or via wireless links such as radio frequency (RF) or infra-red transmitter/receiver devices. In a preferred embodiment of the present invention, the flow measurement device is located within the calibration zone, coupled to VAV controller and activated.

BRIEF DESCRIPTION OF THE DRAWINGS

The FIGURE is a schematic diagram of a flow measurement device and VAV device in accordance with a preferred embodiment of the present invention.

DETAILED DESCRIPTION OF THE PREFERRED EMBODIMENT

With reference to the FIGURE, a zone 10 of a building environment is adapted to receive conditioned air from an air trunk 12 via a VAV device 14 through diffuser 16. The air trunk system is coupled to a supply of conditioned air (not shown) as is well known in the art. VAV device 14 includes a controller 18 and a damper assembly 20. Damper assembly 20 has electrical or pneumatic actuation mechanisms, as is known, for moving at least one damper blade between a plurality of positions for controlling the volume of air entering zone 10 under the control of controller 18. As shown in the Figure, controller 18 receives a control signal from a zone sensing device 22, such as a thermostat, over communication link 24. It should be understood, however, that controller 18 may be adapted to communicate with a central or supervisory controller for receiving control signals.

In the preferred embodiment, VAV device 14 further includes a differential pressure sensor 26 which provides to controller 18 a flow signal indicative of the volume of flow through VAV device 14. Controller 18 is responsive to the flow signal and the control signal for controlling the operation of VAV device 14. Because of the uniqueness, for example, of the air flow pickup, ductwork, static pressure, etc., of each air distribution system, sensor 26 must be calibrated such that the flow signal is indicative of the actual flow.

With continued reference to the FIGURE, a flow hood assembly 30 is installed in zone 10 adjacent diffuser 16. In the preferred embodiment of the present invention, flow hood assembly 30 includes hood 32, flow measuring device 34 and controller 36. Flow hood 32 and measuring device 34 operate in a known manner to determine actual flow from VAV device 14. In the preferred embodiment, this information is provided to controller 34 which formats the information for communication over communication link 38 to controller 18. In the preferred embodiment, controller 34 is coupled via communication link 38 to zone sensing device 22 which is adapted with a communication port. The communication signal is then routed from zone sensing device 22 via communication link 24 to controller 18. It should be understood however, that the communication link may be adapted to directly communicate with controller 18 or to communicate with a central or supervisory controller which is in communication with controller 18. It should be further understood that while shown as a wired link, communication links 24 and 38 may be radio frequency or infra-red links thereby eliminating the need for wiring and/or physically coupling flow measuring device 30 to controller 18. In the preferred embodiment, communications over links 24 and 38 are in accordance with an open communication protocol such as BACnet or the N2 Open protocol developed by Johnson Controls, Inc. 507 E. Michigan Street Milwaukee, Wis. 53202.

In response to signals from controller 36, controller 18 determines proper calibration constants for sensor 26 according to the following equation:

$$K=V_p/(CFM/\text{Box_Area}*4005)^2$$

where K is the calibration constant for sensor 26, Vp is the differential pressure actually measured by sensor 26, CFM is the measured flow in cubic feet/minute, box_area is the box area of VAV device 14 and 4005 is a constant as is known in the art. The value of K is then retained within memory (not shown) associated with controller 18. Calibration information, such as the value of K, the date and time of calibration, etc., may also be communicated to a central or supervisory controller for archival purposes.

In the preferred implementation, either controller 18, controller 34 or a central controller would retain within memory balancing procedures for balancing VAV devices within the air distribution system. Once coupled to controller 18, controller 18 recognizes flow measuring assembly 30 and leaves normal control for calibration. Controller 18 positions VAV device 14 for minimum flow. A signal indicative of minimum flow is produced by flow measuring device 34 and communicated to controller 18. Controller 18 then positions VAV device 14 for maximum flow. Again flow measuring device 34 produces a signal indicative of maximum flow which signal is communicated to controller 18. Controller 18 then determines proper K values for each flow condition and provides an indication to the operator that calibration is completed. In a preferred embodiment, flow measuring assembly includes a display device by which controller 18 may provide the complete signal. Furthermore, the display device may provide an indication to the operator of the next or remaining VAV devices in the system requiring calibration. It should be further understood that after the VAV device is positioned to minimum flow, maximum flow or some other position for calibration (such as a zero flow condition), a suitable amount of time is provided for flow conditions to stabilize prior to measurements being taken.

The present invention has been described in terms of preferred embodiments and such embodiments are not intended to be nor should be taken as limiting. The fair scope of the present invention will be appreciated by those of skill in the art from the following subjoined claims.

We claim:

1. An apparatus for calibrating a variable-air-volume (VAV) device used in an air distribution system to control the flow of conditioned air from a conditioned air source through an air outlet into a zone within a building; the VAV device being disposed between said conditioned air source and said air outlet and including a sensor for sensing a parameter related to the volume of air flowing through the VAV device and producing a sensor output signal related thereto, and a VAV controller responsive to a control signal from an external zone control device for controlling the VAV device in accordance with the sensor output signal; said apparatus comprising:

a flow measuring assembly adapted to be coupled to said air outlet and having a flow measuring device for measuring the actual flow of conditioned air from said outlet into said zone and producing a flow output signal related thereto; and a communication link for communicating said flow output signal to said VAV controller, said VAV controller being responsive to said flow output signal to calibrate said VAV device.

2. The apparatus 1 wherein the flow measuring assembly further includes a device controller adapted to receive flow output signal and to communicate the signal via said communication link to the VAV controller in accordance with a communication protocol.

3. The apparatus of claim 1 wherein the flow measuring assembly is coupled via said external zone control device to the VAV controller.

4. The apparatus of claim 1 wherein the flow measuring assembly further includes a display operable for providing a calibration complete indication.

5. The apparatus of claim 1 wherein the VAV controller further includes a memory containing calibration procedures.

6. The apparatus of claim 1 wherein the VAV controller is coupled to a central controller.

7. The apparatus of claim 1 wherein said communication link comprises one of a wired link, a radio frequency link and an infrared link.

8. A method of calibrating a variable-air-volume (VAV) device used in an air distribution system to control the flow of conditioned air from a conditioned air source through an air outlet into a zone of a building, comprising the steps of:

positioning a flow measuring device to receive the flow of conditioned air from said air outlet;

directing the VAV device to provide one of a plurality of flow conditions;

measuring the resulting actual flow of conditioned air from said air outlet with said flow measuring device and producing a first flow output signal;

communicating said first flow output signal to a controller for said VAV device via a communication link between said flow measuring device and said controller; and determining a first calibration parameter for the VAV device from said first flow output signal.

9. The method of claim 8 further including the step of signaling to an operator completion of the calibration process.

10. The method of claim 8 further comprising the step of communicating the calibration parameter to a central controller.

11. The method of claim 8 wherein the step of directing the VAV device to provide one of a plurality of flow conditions comprises directing the VAV device to provide one of a zero flow condition, a minimum flow condition and a maximum flow condition.

12. The method of claim 8 further including the steps of:

directing the VAV device to provide a second of said plurality of flow conditions;

measuring the resulting actual flow of conditioned air from said air outlet with said flow measuring device and producing a second flow output signal;

communicating said second flow output signal to the controller for the VAV device; and determining a second calibration parameter for said VAV device from said second flow output signal.

* * * * *